US007306426B2

(12) United States Patent
Franz et al.

(10) Patent No.: US 7,306,426 B2
(45) Date of Patent: Dec. 11, 2007

(54) PROTECTION MECHANISM FOR FLOW INDUCING DEVICE

(75) Inventors: John P. Franz, Houston, TX (US); David L. Vaughn, Spring, TX (US); Steven D. Webster, Spring, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 726 days.

(21) Appl. No.: 10/783,147

(22) Filed: Feb. 20, 2004

(65) Prior Publication Data

US 2005/0186071 A1 Aug. 25, 2005

(51) Int. Cl.
*F04D 29/00* (2006.01)

(52) U.S. Cl. ..... 415/123; 415/126; 416/169 R

(58) Field of Classification Search ..... 415/149.2, 415/151, 123, 121.2, 126; 416/169 R, 247 R
See application file for complete search history.

(56) References Cited

U.S. PATENT DOCUMENTS

| | | | | |
|---|---|---|---|---|
| 3,401,874 | A * | 9/1968 | Covington | 416/142 |
| 4,480,205 | A | 10/1984 | Nymann | |
| 5,921,753 | A * | 7/1999 | Ames | 416/169 R |
| 5,944,488 | A | 8/1999 | Matson | |
| 6,174,232 | B1 * | 1/2001 | Stoll et al. | 454/184 |
| 6,213,718 | B1 | 4/2001 | Hill et al. | |
| 6,422,814 | B1 * | 7/2002 | Dickey et al. | 415/123 |
| 2002/0159883 | A1 | 10/2002 | Simon et al. | |

* cited by examiner

*Primary Examiner*—Ninh H. Nguyen

(57) ABSTRACT

A rotary flow inducing device having a rotary flow inducing blade and a protection mechanism including a trigger to move the protection mechanism between an operational flow configuration and a protective no-flow configuration with respect to the rotary flow inducing blade.

37 Claims, 7 Drawing Sheets

PROTECTION MECHANISM FOR FLOW INDUCING DEVICE

BACKGROUND OF THE RELATED ART

This section is intended to introduce the reader to various aspects of art, which may be related to various aspects of the present technique that are described and/or claimed below. This discussion is believed to be helpful in providing the reader with background information to facilitate a better understanding of the various aspects of the present invention. Accordingly, it should be understood that these statements are to be read in this light, and not as admissions of prior art.

Electronic devices, such as laptops, desktop computers, and servers, create heat that can cause decreased performance, failure, or malfunction. Therefore, cooling systems may be employed to remove this heat. For example, fans are often used to provide forced air cooling. In certain systems, such as servers, service personnel often remove, replace, or install fans during operation. Thus, the rotating fan blades present a risk of user harm without the appropriate protective measures. Unfortunately, the typical finger guard or fan grill restricts the airflow, thereby decreasing the cooling efficiency of the fan. These guards and grills also increase noise levels associated with airflow passing through the fan. Similar problems exist with other fluid systems having flow devices, such as pumps and compressors, which may be accessed during operation of the system.

SUMMARY

A rotary flow inducing device having a rotary flow inducing blade and a protection mechanism including a trigger to move the protection mechanism between an operational flow configuration and a protective no-flow configuration with respect to the rotary flow inducing blade.

BRIEF DESCRIPTION OF THE DRAWINGS

Advantages of one or more disclosed embodiments may become apparent upon reading the following detailed description and upon reference to the drawings in which.

DETAILED DESCRIPTION

One or more specific embodiments of the present technique will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
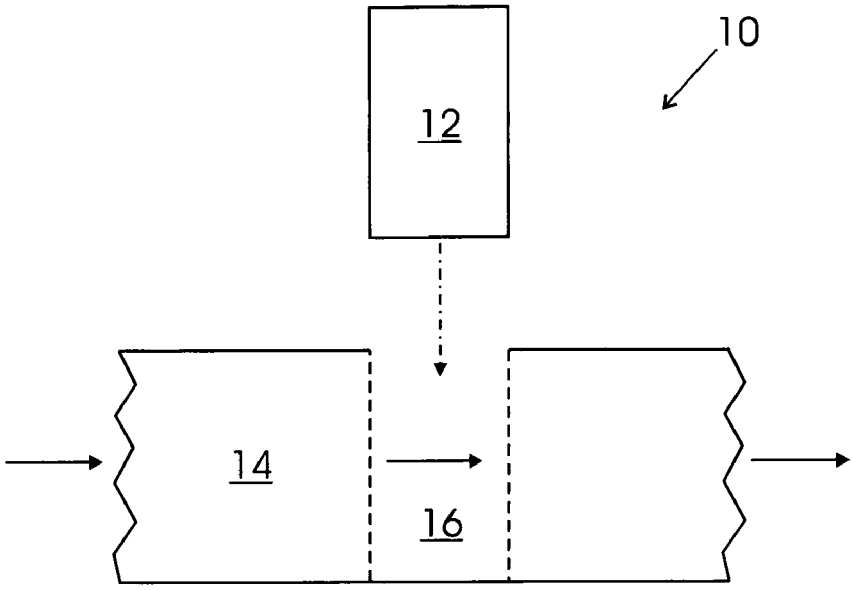
FIG. 1 is a cross-sectional view of a system having a removable flow device in accordance with embodiments of the present invention.

Turning now to the figures, FIG. 1 is a cross-sectional view of a system 10 comprising a flow device 12, a flow passage 14, and a mounting region 16 in accordance with various embodiments of the present invention. For example, the system 10 may comprise an electronic device, such as a computer. Thus, the flow device 12 may be a cooling fan disposed in a rack mount electronics system, a rack mount computer system, a server, a desktop computer, a laptop computer, or other processor based device. In certain embodiments, the flow device 12 may comprise a rotary flow inducing device, such as a rotary fan, having one or more rotary flow inducing blades. Other possible applications may include industrial heat transfer and/or fluid transfer/mixing systems, such as those found in chemical plants, nuclear facilities, natural resource processors and other facilities, water treatment facilities, waste processing systems, and various other systems depending on fluid flow or agitation. Thus, the system 10 also may comprise other pneumatic or fluid control or flow devices 12, such as a pump, a compressor, or an expander.

The flow device 12 of system 10 is configurable into at least two positional stages or configurations, an operational flow configuration and a protective no-flow configuration. More specifically, the protective no-flow configuration blocks or stops the moving components of the flow device 12 during removal of the flow device 12 from the mounting region 16. The operational flow configuration disables mechanisms associated with the protective no-flow configuration to permit operation of the flow device 12 to optimize flow while the flow device 12 is disposed within mounting region 16. For example, certain embodiments of the flow device 12 may have a blind mechanism, which moves between open and closed positions in the operational flow and protective no-flow configurations, respectively. By further example, other embodiments of the flow device 12 may have a braking mechanism, which moves between free and braked positions in the operational flow and protective no-flow configurations, respectively. As discussed in detail below, these operational flow and protective no-flow configurations may be selectively or automatically changed as the flow device 12 is moved between an inserted position and a removed position with respect to the mounting region 16.

Figure 2:
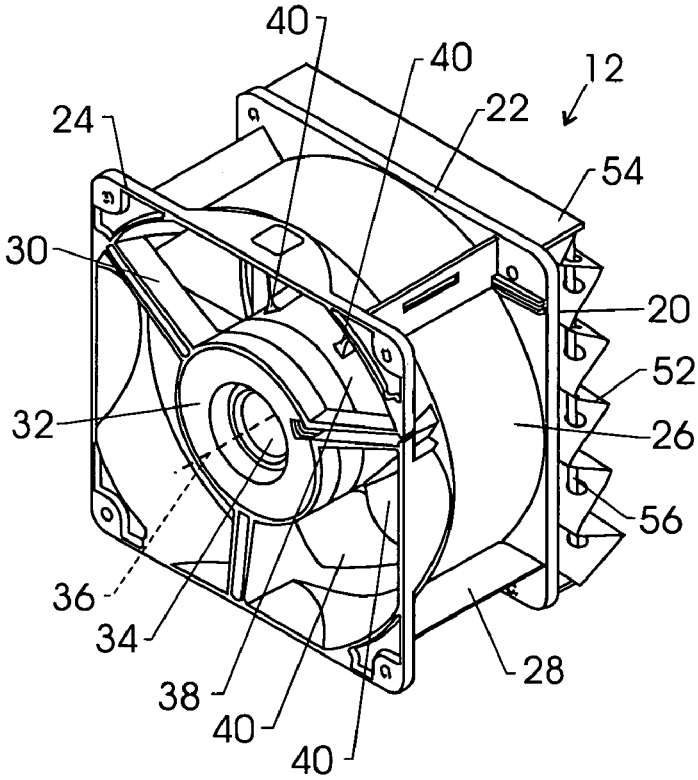
FIG. 2 is a perspective view of a flow device in accordance with embodiments of the present invention.

FIG. 2 is a perspective view of one embodiment of the flow device 12. In the illustrated embodiment, the flow device 12 comprises a rotary flow inducing device, such as a rotary air-moving fan. However, the flow device 12 may comprise a variety of flow inducing devices for a heating airflow, a cooling airflow, a heating fluid flow, a cooling fluid flow, and so forth. This embodiment, as illustrated, comprises a housing 20 having a front flange 22, a back flange 24, and a central cylindrical portion 26 coupled to the front flange 22 and back flange 24. Other embodiments may comprise alternate geometries and/or means of support to form a housing 20. Further, additional structural support is provided by a truss 28, which attaches to both the cylindrical portion 26 and the front and back flanges 22 and 24. The back flange 24 further comprises a bracket 30, which supports a motor and/or bearing assembly 32 having a central rotor 34 rotatable about an axis of rotation 36. The rotor 34 extends to a movable hub 38, which has a plurality of impellers or blades 40 extending therefrom. In operation, these impellers or blades 40 rotate with along with rotation of the movable hub 38 within the cylindrical portion 26.

Figure 3:
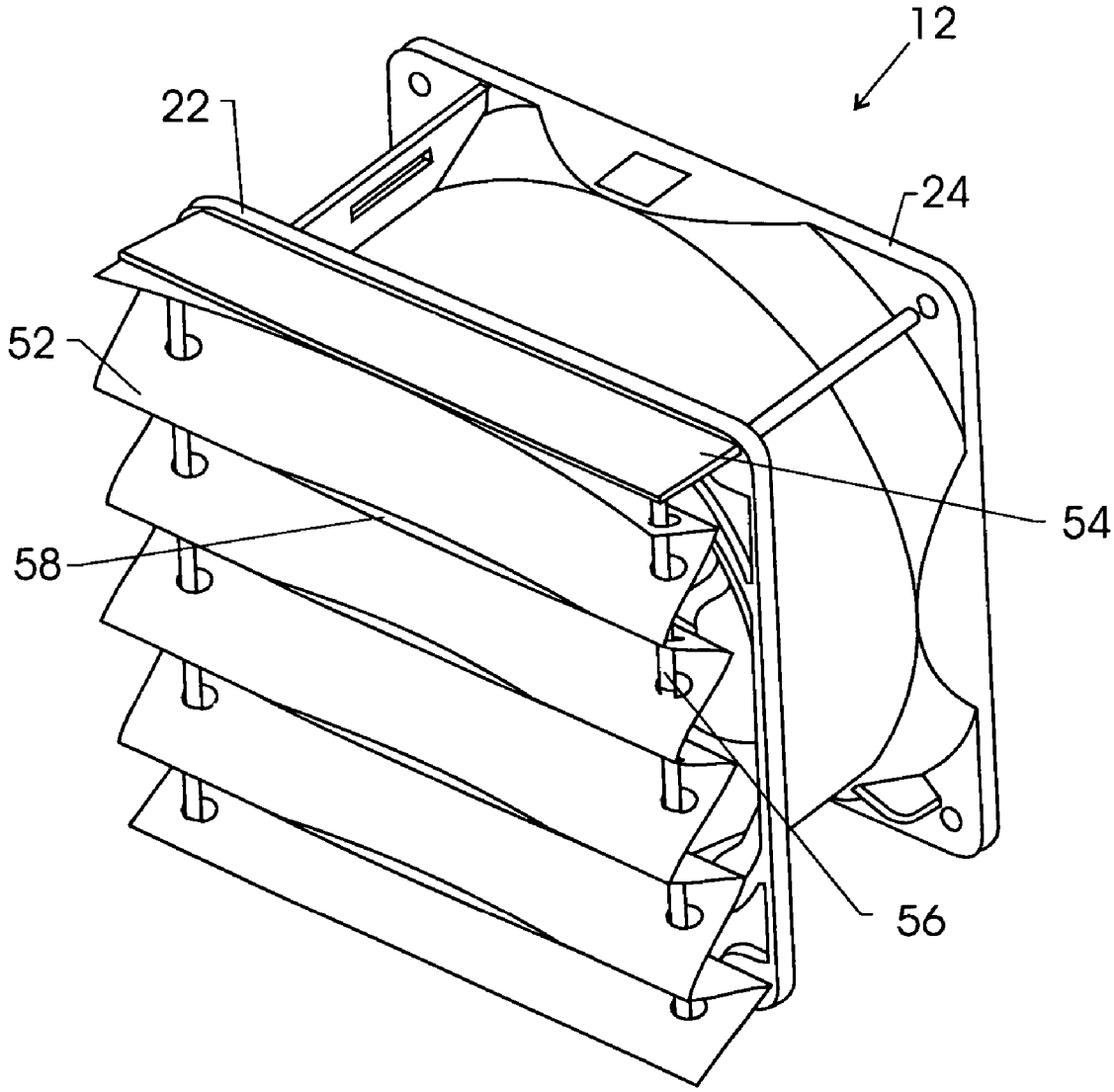
FIG. 3 is a perspective view of a flow device having a retractable blind in accordance with embodiments of the present invention.

As illustrated in FIGS. 2 and 3, the flow device 12 also has a retractable blind 52 coupled to an upper lip or edge portion 54 of the front flange 22. As discussed in detail below, the blind 52 is movable along guides 56 between a protective no-flow configuration (blind closed) and an operational flow configuration (blind open). Other embodiments of the blind 52 may comprise an iris, a sheet, links, multiple bars, or other means of providing a retractable barrier. However, each of these embodiments has a protective no-flow configuration (blind closed) and an operational flow configuration (blind open). The compressibility of the retractable blind 52 also may be enhanced by selective removal of material to create slits 58, such as those shown in FIG. 3.

Figure 4:
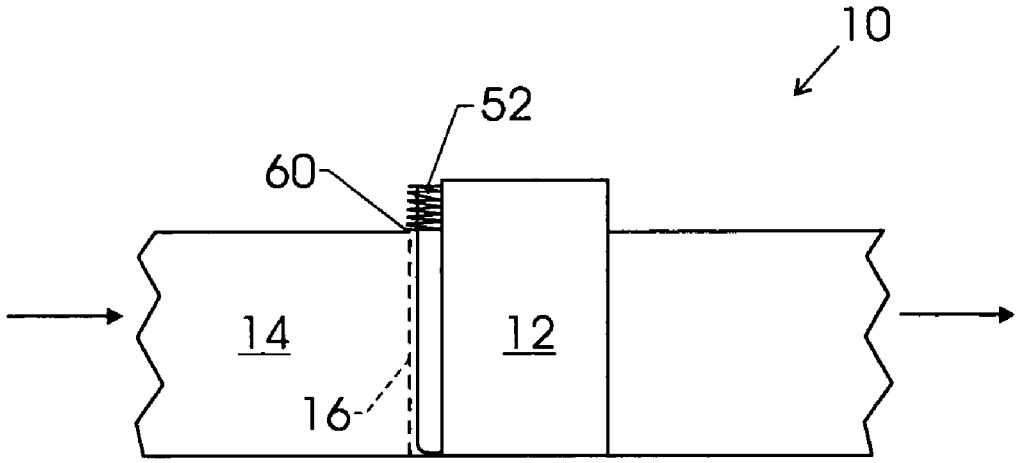
FIG. 4 is a cross-sectional view of the flow device of FIG. 3 having the retractable blind in a retracted configuration within a flow passage in accordance with embodiments of the present invention.

FIG. 4 represents a cross-sectional view of one embodiment of the flow device 12 with the retractable blind 52 disposed in an inserted position within the mounting region 16. During insertion, the retractable blind 52 compresses or folds in an alternating or zig-zagging manner upon engagement with an edge or lip 60 of the mounting region 16. Upon complete insertion, the retractable blind 52 is fully compressed, as is illustrated by FIG. 4. In the fully compressed position, the blind 52 facilitates substantially full and unencumbered air flow through the flow device 12.

Figure 5:
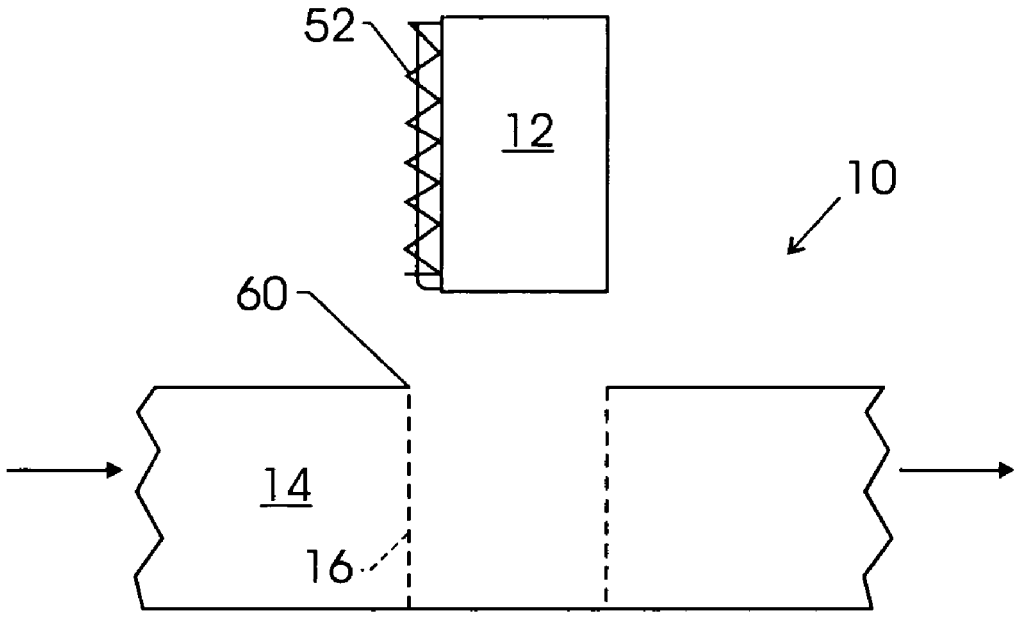
FIG. 5 is a cross-sectional view of the flow device of FIG. 3 removed from the flow passage and having the retractable blind in a protective no-flow configuration in accordance with embodiments of the present invention.

Upon removal, the retractable blind 52 expands to a protective no-flow configuration (blinds closed), which protects or blocks the moving parts of the flow device 12. Accordingly, if the flow device 12 is removed during operation, then the moving parts are inaccessible. The embodiment illustrated by FIG. 5 depicts a fully removed flow device 12 and a fully expanded retractable blind 52. In the illustrated embodiment, the expansion of the retractable blind 52 is due to gravity and the elastic nature of the material comprising the retractable blind 52. Alternatively, springs, coils, elastic materials, magnets or other biasing mechanisms could be used to cause this expansion of the retractable blind 52.

Figure 6:
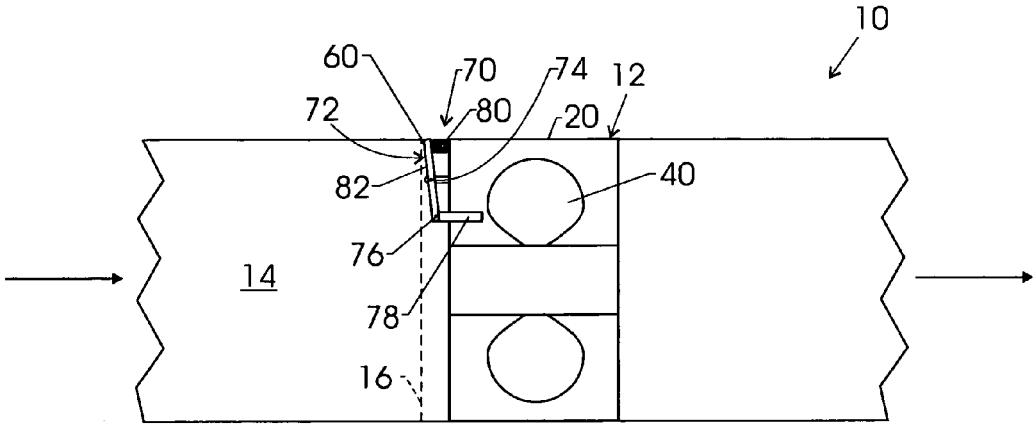
FIG. 6 is a cross-sectional view of a flow device having a brake assembly in a disengaged configuration within a flow passage in accordance with embodiments of the present invention.
Figure 7:
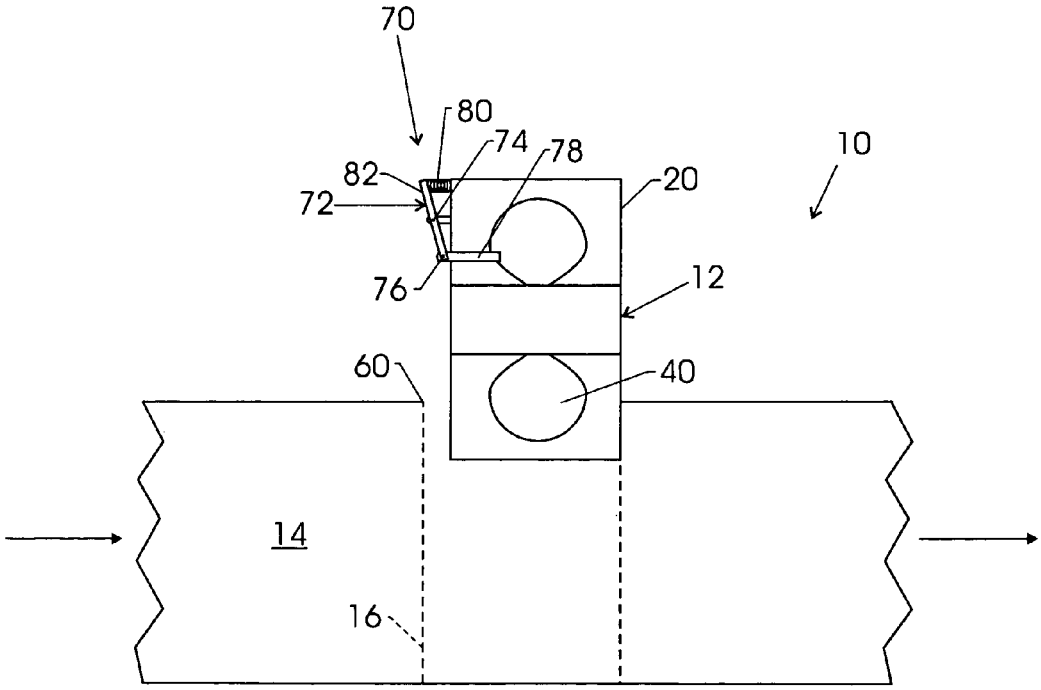
FIG. 7 is a cross-sectional view of the flow device of FIG. 6 removed from the flow passage and having the brake assembly in an engaged configuration in accordance with embodiments of the present invention.

FIGS. 6 and 7 represent an alternative embodiment of the flow device 12 comprising a brake assembly 70 in two different configurations, i.e., an operational flow configuration (FIG. 6) and a protective no-flow configuration (FIG. 7). FIG. 6 is a cross-sectional view of system 10 illustrating the flow device 12 disposed within the mounting region 16. In the illustrated embodiment, the brake assembly 70 comprises a lever arm 72 coupled to the housing 20 by a first pivot joint 74 and coupled to an engaging arm 78 by a second pivot joint 76. In certain embodiments, the brake assembly 70 may be a single piece or multiple pieces. Additionally, the brake assembly 70 comprises a spring mechanism 80, which interacts with an upper portion 82 of the lever arm 72 and with the housing 20 to bias the engaging arm 78 inwardly toward the blades 40. More specifically, the spring mechanism 80 biases the lever arm 72 to rotate about the first pivot joint 74 in a counter clockwise direction. However, in the inserted configuration of FIG. 6, the lip 60 counteracts the spring mechanism 80 to rotate the lever arm 72 clockwise out of engagement with the blades 40. Upon removal, the spring mechanism 80 rotates the lever arm 72 about the pivot joint 74, thereby forcing the engaging arm 78 to engage the blades 40. Thus, the brake assembly 70 stops rotation of the blades 40 during removal of the flow device 12 from the system 10. In other embodiments, the spring mechanism 80 may be replaced by other means of providing resilient bias.

Turning now to FIG. 7, the flow device 12 is being removed from the mounting region 16, thereby engaging the brake assembly 70 against the blades 40. During removal of the flow device 12, the spring mechanism 80 expands against the upper portion 82 of the lever arm 72 to pivot the lever arm 72 counter clockwise about the pivot joint 74, thereby biasing the engaging arm 78 against the blades 40. As a result, the engaging arm 78 immediately or progressively stops rotation of the blades 40. In certain embodiments, the engaging arm 78 may be made of a material that is flexible, rubberized, inflexible, feathered, or textured. Additionally, other embodiments of the brake assembly 70 may comprise a spring loaded pin, a disc brake, an air brake, a drum brake, and various other braking mechanisms and controls. For example, these braking mechanisms may have mechanical triggers, electrical triggers, software-based triggers, and so forth.

Figure 8:
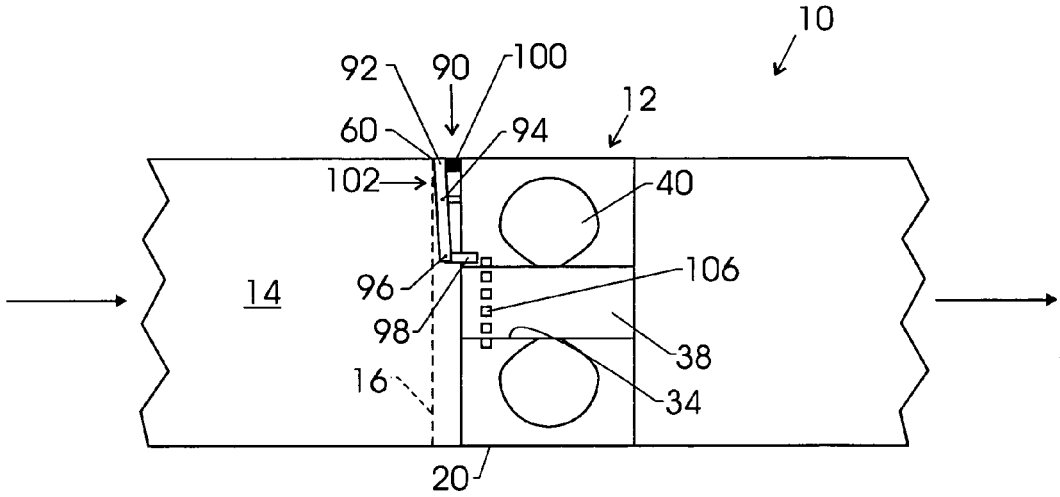
FIG. 8 is a cross-sectional view of a flow device having an alternative brake assembly in a disengaged configuration within a flow passage in accordance with embodiments of the present invention.
Figure 9:
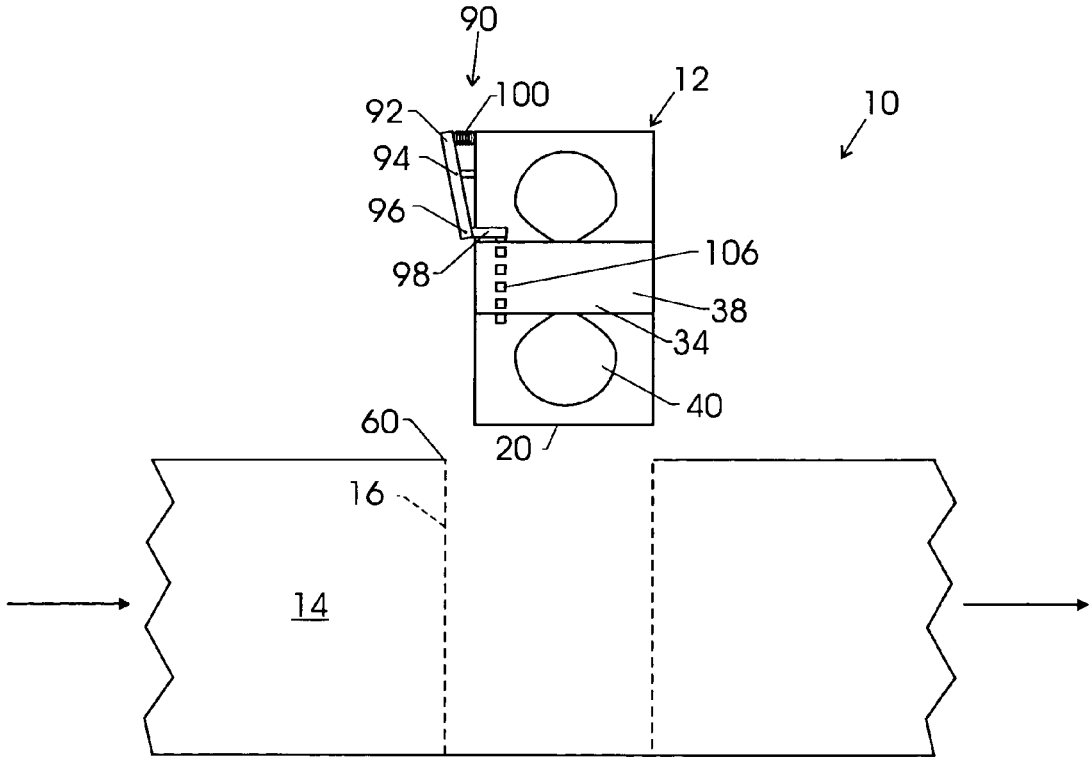
FIG. 9 is a cross-sectional view of the flow device of FIG. 8 removed from the flow passage and having the brake assembly in an engaged configuration in accordance with embodiments of the present invention.

FIGS. 8 and 9 represent an alternative embodiment of the flow device 12 comprising a brake assembly 90 in two different configurations, i.e., an operational flow configuration (FIG. 8) and a protective no-flow configuration (FIG. 9). FIG. 8 is a cross-sectional view of system 10 illustrating the flow device 12 disposed within the mounting region 16. In the illustrated embodiment, the brake assembly 90 comprises a lever arm 92 coupled to the housing 20 by a first pivot joint 94 and coupled to an engaging arm 98 by a second pivot joint 96. In certain embodiments, the brake assembly 90 may be a single piece or multiple pieces with or without pivot joints. Additionally, the brake assembly 90 comprises a spring mechanism 100, which interacts with an upper portion 102 of the lever arm 92 and with the housing 20 to bias the engaging arm 98 inwardly toward the blades 40. More specifically, the spring mechanism 100 biases the lever arm 92 to rotate about the first pivot joint 94 in a counter clockwise direction. However, in the inserted configuration of FIG. 8, the lip 60 counteracts the spring mechanism 100 to rotate the lever arm 92 clockwise out of engagement with the blades 40. Upon removal, the spring mechanism 100 rotates the lever arm 92 about the pivot joint 94, thereby forcing the engaging arm 98 to engage nubs, nodules, or stopping members 106 disposed about the hub 38. Thus, the brake assembly 90 stops rotation of the hub 38 and blades 40 during removal of the flow device 12 from the system 10.

In the illustrated embodiment of FIGS. 8 and 9, the nodules 106 are shown disposed along the outer circumference of the hub 38. However, other embodiments can be envisaged wherein the nodules are disposed along the inner circumference of the hub 38, along the outer edges of the blades 40, on a contour disposed around the outer edge of rotor 34, or along some other portion of the rotor 34. Additionally, the nodules 106 may be rubberized, textured, inflexible or otherwise to improve functionality. In other embodiments, the nodules 106 may be replaced by a frictional contact member, which creates a stopping force by friction or resistance between the brake assembly 90 and a corresponding portion of the rotor 34 or hub 38.

Turning now to FIG. 9, the flow device 12 is being removed from the mounting region 16, thereby engaging the brake assembly 90 against the nubs or nodules 106. During removal of the flow device 12, the spring mechanism 100 expands against the upper portion 102 of the lever arm 92 to pivot the lever arm 92 counter clockwise about the pivot joint 94, thereby biasing the engaging arm 98 against the nubs or nodules 106. As a result, the engaging arm 98 immediately or progressively stops rotation of the hub 38 and blades 40. Again, certain embodiments of the engaging arm 98 may be made of a material that is flexible, rubberized, inflexible, feathered, or textured. In addition, some embodiments of the brake assembly 90 may have mechanical triggers, electrical triggers, software-based triggers, and so forth.

Figure 10:
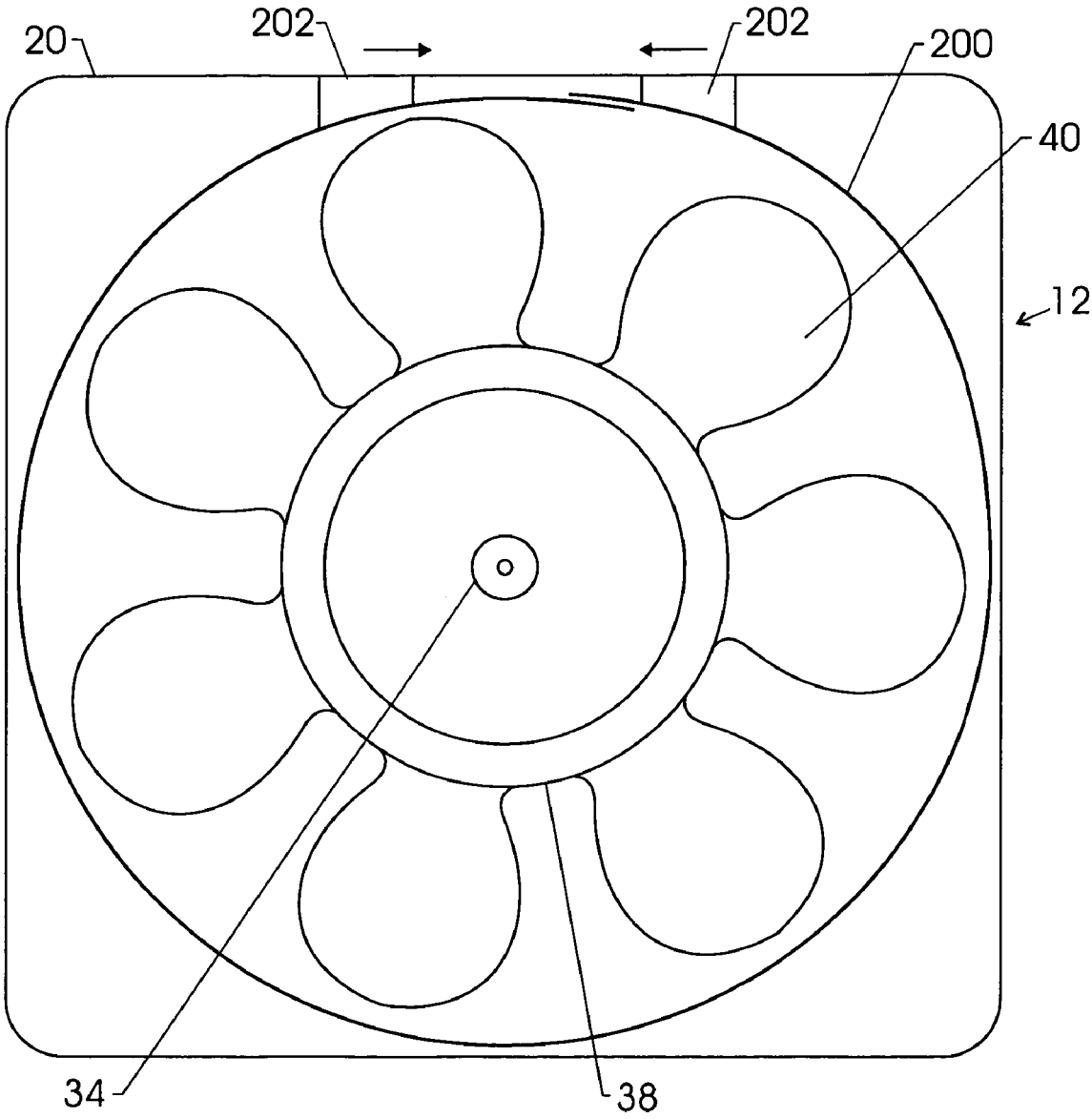
FIG. 10 is a cross-sectional view of a flow device having an outer brake assembly in accordance with embodiments of the present invention.

FIG. 10 illustrates another embodiment of the flow device 12 having a brake band 200, which encircles the movable (rotatable) components of the flow device 12, i.e., the rotor 34, hub 38, and blades 40. In other embodiments, the brake band 200 may partially encircle one or more of these movable (rotatable) components of the flow device 12. Additionally, certain embodiments may include additional parts, such as a band around the outer edge of the blades 40, for substantially reducing component wear during braking of the flow device 12. As illustrated, the brake band 200 comprises lift guides 202 that are accessible from the top of the housing 20. The lift guides 202 are moveable towards each other (see arrows in FIG. 10) to constrict the brake band 200 into compressive engagement with fan blades 40, thereby preventing rotation of the movable (rotatable) components of the flow device 12, i.e., the rotor 34, the hub 38, and/or the blades 40.

Figure 11:
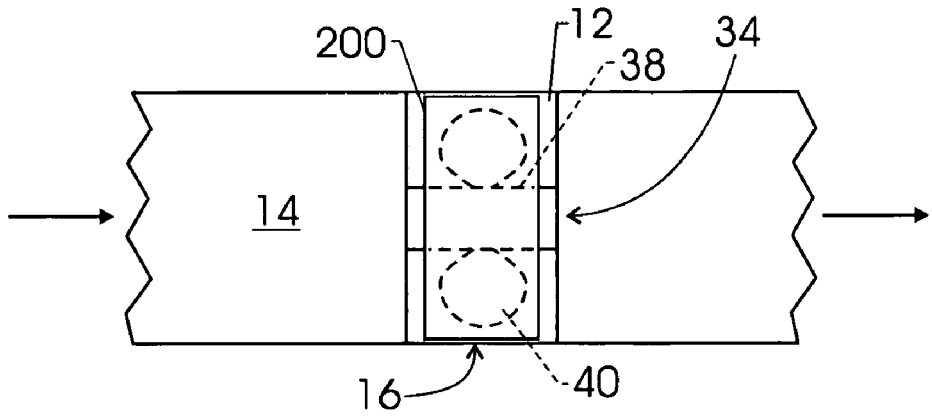
FIG. 11 is a cross-sectional view of the flow device of FIG. 10 within the flow passage and having the outer brake assembly in a disengaged configuration in accordance with embodiments of the present invention.
Figure 12:
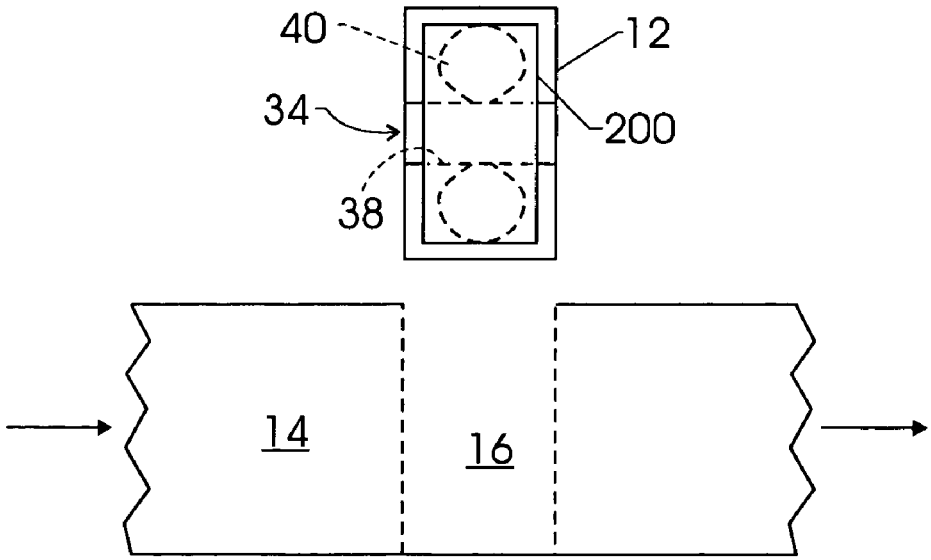
FIG. 12 is a cross-sectional view of the flow device of FIG. 10 removed from a flow passage and having the outer brake assembly in an engaged configuration in accordance with embodiments of the present invention.

FIGS. 11 and 12 represent the flow device 12 of FIG. 10 having the brake band 200 in two different configurations, i.e., an operational flow configuration (FIG. 11) and a protective no-flow configuration (FIG. 12). FIG. 11 is a cross-sectional view of system 10 illustrating the flow device 12 disposed within the mounting region 16. In the installed position, the blades 40 are free to move without restriction, because the brake band 200 is not constricted about the moving parts of the flow device 12.

FIG. 12 is a cross-sectional view of system 10 illustrating the flow device 12 removed from the mounting region 16. In operation, the flow device 12 can be removed from the mounting region 16 by inserting a user's fingers into the lift guides 202, pushing the lift guides 202 together to constrict about and brake the moving parts of the flow device 12, and lifting the flow device 12 out of the mounting region 16. Advantageously, the engagement of the braking band 200 secures and protects the moving parts of the flow device 12. The braking band 200 also functions to stop the moving parts of the flow device 12 as the flow device 12 is removed during operation of the system 10.

While the technique may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A rotary flow inducing device, comprising:

a rotary flow inducing blade, and a protection mechanism comprising a trigger to move the protection mechanism between an operational flow configuration and a protective no-flow configuration with respect to the rotary flow inducing blade, wherein the protection mechanism comprises a collapsible wall blocking a flow path of the rotary flow inducing blade in the protective no-flow configuration, the collapsible wall is retracted from the flow path in the operational flow configuration, and the rotary flow inducing blade is configured to rotate for at least some duration during the protective no-flow configuration.

2. The flow inducing device recited in claim 1, wherein the collapsible wall comprises a blind having a plurality of folded portions alternatingly offset from one another.

3. The flow inducing device recited in claim 1, wherein the protection mechanism comprises a motion suppression device adapted to suppress motion of the rotary flow inducing blade in the protective no-flow configuration.

4. The flow inducing device recited in claim 3, wherein the motion suppression device comprises a resilient brake mechanism.

5. The flow inducing device recited in claim 1, wherein the collapsible wall is configured to open and close in a generally linear direction.

6. The flow inducing device recited in claim 1, comprising a fan having a plurality of blades including the rotary flow inducing blade, wherein the plurality of blades radiate outward from a hub in the same manner in both the operational flow configuration and the protective no-flow configuration.

7. A system, comprising:

a chassis having a receptacle;

a rotary flow inducing device movable between an inserted position in the receptacle and a removed position from the receptacle, wherein the rotary flow inducing device comprises a plurality of rotary flow inducing blades in a flow passage; and a blind mechanism coupled to the rotary flow inducing device, wherein the blind mechanism has an open configuration freeing the flow passage in the inserted position and a closed configuration blocking the flow passage in the removed position.

8. The system of claim 7, wherein the chassis comprises a rack mount electronics system.

9. The system of claim 7, wherein the chassis comprises a computer system.

10. The system of claim 7, wherein the rotary flow inducing device comprises a cooling fan.

11. The system of claim 7, wherein the blind mechanism comprises an actuator that is engageable with a portion of the receptacle.

12. A system, comprising:

a chassis having a receptacle;

a rotary flow inducing device movable between an inserted position in the receptacle and a removed position from the receptacle, wherein the rotary flow inducing device comprises a plurality of rotary flow inducing blades in a flow passage;

a braking mechanism coupled to the rotary flow inducing device, wherein the braking mechanism has a free configuration permitting rotation of the plurality of rotary flow inducing blades in the inserted position and a braked configuration suppressing rotation of the plurality of rotary flow inducing blades in the removed position; and an actuator coupled to the braking mechanism and adapted to change the braking mechanism from the free configuration to the braked configuration upon removal from the receptacle, wherein the braking mechanism comprises a stopping member engageable with a rotary hub supporting the plurality of rotary flow inducing blades in the braked configuration.

13. The system of claim 12, wherein the chassis comprises a rack mount electronics system.

14. The system of claim 12, wherein the chassis comprises a computer system.

15. The system of claim 12, wherein the rotary flow inducing device comprises a cooling fan.

16. A system, comprising:

means for blocking and unblocking a flow passage of a rotary flow inducing device having a plurality of rotary flow inducing blades disposed in the flow passage; and means for actuating the means for blocking and unblocking upon movement of the rotary flow inducing device to a removed position from a receptacle and to an inserted position in the receptacle, respectively.

17. A method, comprising:

providing a rotary flow inducing device movable between an inserted position in a receptacle and a removed position from the receptacle, wherein the rotary flow inducing device comprises a plurality of rotary flow inducing blades in a flow passage; and providing a blind mechanism coupleable to the rotary flow inducing device, wherein the blind mechanism has an open configuration freeing the flow passage in the inserted position and a closed configuration obstructing the flow passage in the removed position.

18. The method of claim 17, wherein providing the rotary flow inducing device comprises mounting the rotary flow inducing device in the receptacle of an electronics chassis.

19. The method of claim 17, wherein providing the rotary flow inducing device comprises assembling a computer system having the rotary flow inducing device mounted in the receptacle of a computer chassis.

20. The method of claim 17, wherein providing the blind mechanism comprises coupling a collapsible blind structure along a wall of the rotary flow inducing device, such that the open configuration has the collapsible blind structure collapsed at an upper portion of the wall.

21. The method of claim 17, wherein providing the blind mechanism comprises providing a blind actuator to move the blind mechanism between the closed configuration and the open configuration upon removal from the receptacle and upon insertion into the receptacle, respectively.

22. A method, comprising:

providing a rotary flow inducing device movable between an inserted position in a receptacle and a removed position from the receptacle, wherein the rotary flow inducing device comprises a plurality of rotary flow inducing blades in a flow passage;

providing a braking mechanism coupleable to the rotary flow inducing device, wherein the braking mechanism has a free configuration permitting rotation of the plurality of rotary flow inducing blades in the inserted position and a braked configuration suppressing rotation of the plurality of rotary flow inducing blades in the removed position, wherein the braking mechanism comprises a stopping member engageable with a rotary hub supporting the plurality of rotary flow inducing blades in the braked configuration, or the braking mechanism comprises an outer band disposed about the plurality of rotary flow inducing blades and constrictable onto the plurality of rotary flow inducing blades in the braked configuration; and providing an actuator coupled to the braking mechanism and adapted to change the braking mechanism from the free configuration to the braked configuration upon removal from the receptacle.

23. The method of claim 22, wherein providing the rotary flow inducing device comprises mounting the rotary flow inducing device in the receptacle of an electronics chassis.

24. The method of claim 22, wherein providing the rotary flow inducing device comprises assembling a computer system having the rotary flow inducing device mounted in the receptacle of a computer chassis.

25. The method of claim 22, wherein providing the braking mechanism comprises providing a stopping member engageable with the plurality of rotary flow inducing blades in the braked configuration.

26. The method of claim 22, wherein the braking mechanism comprises the stopping member engageable with the rotary hub supporting the plurality of rotary flow inducing blades in the braked configuration.

27. The method of claim 22, wherein the braking mechanism comprises the outer band disposed about the plurality of rotary flow inducing blades and constrictable onto the plurality of rotary flow inducing blades in the braked configuration.

28. A system, comprising:

a fan adapted for insertion into and removal from an electronics chassis during operation of the fan;

a blind mechanism coupled to the fan, wherein the blind mechanism has an open configuration freeing flow of the fan in the inserted position and a closed configuration blocking flow of the fan in the removed position; and a computer system having the fan mounted in a receptacle of the electronics chassis.

29. The system of claim 28, wherein the blind mechanism comprises a blind actuator adapted to move a collapsible blind structure between the closed configuration and the open configuration upon removal from the receptacle and upon insertion into the receptacle, respectively.

30. A system, comprising:

a fan adapted for insertion into and removal from an electronics chassis during operation of the fan, wherein the fan comprises a plurality of fan blades;

a braking mechanism coupled to the fan, wherein the braking mechanism has a free configuration permitting movement of the fan blades in the inserted position and a braked configuration suppressing movement of the fan blades in the removed position, wherein the braking mechanism comprises a stopping member engageable with a rotary hub supporting the fan blades in the braked configuration; and an actuator coupled to the braking mechanism and adapted to change the braking mechanism from the free configuration to the braked configuration upon removal from the receptacle.

31. The system of claim 30, comprising a computer system having the fan mounted in a receptacle of the electronics chassis.

32. The system of claim 30, wherein the braking mechanism comprises a stopping member engageable with the fan blades in the braked configuration.

33. The system of claim 30, wherein the rotary hub comprises a plurality of protruding tabs engageable with the stopping member in the braked configuration.

34. A system, comprising:

a fan adapted for insertion into and removal from an electronics chassis during operation of the fan, wherein the fan comprises a plurality of fan blades;

a braking mechanism coupled to the fan, wherein the braking mechanism has a free configuration permitting movement of the fan blades in the inserted position and a braked configuration suppressing movement of the fan blades in the removed position, wherein the braking mechanism comprises an outer band disposed about the fan blades and constrictable onto the fan blades in the braked configuration; and an actuator coupled to the braking mechanism and adapted to change the braking mechanism from the free configuration to the braked configuration upon removal from the receptacle.

35. The system of claim 34, wherein the braking mechanism comprises at least one finger grip coupled to the outer band and movable to constrict the outer band.

36. The system of claim 35, comprising a computer system having the fan mounted in a receptacle, wherein the brake is configured to automatically engage as the fan is removed from the receptacle.

37. A system, comprising:

a fan comprising a plurality of blades configured to rotate about an axis of rotation, wherein the plurality of blades are configured to create airflow in a path generally along the axis of rotation; and a brake configured to move axially toward the blades to brake the blades.

* * * * *